US006772523B1

(12) United States Patent
Richard et al.

(10) Patent No.: US 6,772,523 B1
(45) Date of Patent: Aug. 10, 2004

(54) PIVOTABLE AND FLEXIBLE RAZOR ASSEMBLY AND CARTRIDGE

(75) Inventors: Paul Richard, Shelton, CT (US); Thomas Follo, Milford, CT (US); Andrew Pennella, Stamford, CT (US)

(73) Assignee: Eveready Battery Company, Inc., St. Louis, MI (US)

( * ) Notice: Subject to any disclaimer, the term of this patent is extended or adjusted under 35 U.S.C. 154(b) by 0 days.

(21) Appl. No.: 09/295,876

(22) Filed: Apr. 21, 1999

(51) Int. Cl.[7] ..... B26B 21/14
(52) U.S. Cl. ..... 30/527; 30/50
(58) Field of Search ..... 30/50, 47, 41, 30/526, 527

(56) References Cited

U.S. PATENT DOCUMENTS

| | | | | |
|---|---|---|---|---|
| 1,920,711 | A | 8/1933 | Pelizzola | |
| 2,127,881 | A | 8/1938 | Morris | |
| 2,487,886 | A | 11/1949 | McCune | |
| 3,262,206 | A | 7/1966 | Tomek | |
| 3,660,893 | A | 5/1972 | Welsh | |
| 3,786,563 | A | 1/1974 | Dorion, Jr. et al. | |
| 3,935,639 | A | 2/1976 | Terry et al. | |
| 3,975,820 | A | 8/1976 | Torance | |
| 4,026,016 | A | 5/1977 | Nissen | |
| 4,044,120 | A | 8/1977 | Rowsell et al. | 424/48 |
| 4,094,063 | A * | 6/1978 | Trotta | 30/527 |
| 4,146,958 | A | 4/1979 | Chen et al. | |
| 4,170,821 | A | 10/1979 | Booth | 30/41 |
| 4,200,976 | A | 5/1980 | Gooding | |
| 4,227,302 | A | 10/1980 | Torrance | |

(List continued on next page.)

FOREIGN PATENT DOCUMENTS

| | | |
|---|---|---|
| GB | 2162111 | 1/1986 |
| JP | 5643437 | 10/1981 |
| JP | 0583177 | 1/1983 |
| JP | 5888974 | 6/1983 |
| JP | 58138571 | 9/1983 |
| JP | 58138572 | 9/1983 |
| JP | 0602476 | 1/1985 |
| JP | 60179277 | 11/1985 |
| JP | 0636577 | 5/1994 |
| JP | 6039644 | 5/1994 |
| JP | 0655562 | 8/1994 |
| JP | 6509243 | 10/1994 |
| JP | 7501252 | 2/1995 |
| JP | 9502912 | 3/1997 |
| JP | 2546261 | 5/1997 |
| JP | 9135972 | 5/1997 |
| JP | 9135973 | 5/1997 |
| JP | 9168677 | 6/1997 |
| JP | 9187585 | 7/1997 |
| JP | 9276567 | 10/1997 |
| JP | 9276568 | 10/1997 |
| JP | 9285663 | 11/1997 |
| JP | 0998906 | 12/1997 |
| JP | 9308779 | 12/1997 |
| JP | 9308780 | 12/1997 |
| JP | 9308781 | 12/1997 |
| JP | 10500888 | 1/1998 |
| JP | 63139873 | 9/1998 |
| JP | 10290891 | 11/1998 |
| WO | WO9310947 | 6/1993 |
| WO | WO9505272 | 2/1995 |
| WO | WO9509071 | 4/1995 |
| WO | WO9529798 | 11/1995 |
| WO | WO9629183 | 9/1996 |
| WO | WO9737818 | 10/1997 |
| WO | WO9805478 | 2/1998 |
| WO | WO9920440 | 4/1999 |

*Primary Examiner*—Hwei-Siu Payer
(74) *Attorney, Agent, or Firm*—McCormick, Paulding & Huber LLP

(57) ABSTRACT

A pivotable and/or flexible razor cartridge is provided. The cartridge may be adapted to flex through a neutral plane which extends through a shaving aid thereof. In an alternate embodiment, the cartridge may be both flexible and pivotable.

26 Claims, 9 Drawing Sheets

U.S. PATENT DOCUMENTS 4,266,340 A 5/1981 Bowman
4,270,268 A 6/1981 Jacobson
4,281,455 A 8/1981 Dixon et al.
4,288,920 A 9/1981 Douglass et al.
4,335,508 A 6/1982 Francis et al.
4,345,374 A 8/1982 Jacobson
4,347,663 A 9/1982 Ullmo
4,378,634 A 4/1983 Jacobson
4,407,067 A 10/1983 Trotta
4,409,735 A * 10/1983 Cartwright et al. ..... 30/47
4,428,116 A 1/1984 Chen et al.
4,442,598 A 4/1984 Jacobson
4,443,939 A * 4/1984 Motta et al. ..... 30/47
4,480,387 A 11/1984 d'Alayer de Costemore d'Arc
4,488,357 A 12/1984 Jacobson
4,492,025 A 1/1985 Jacobson
4,501,066 A 2/1985 Sceberras
4,514,904 A 5/1985 Bond
4,534,110 A 8/1985 Glass
4,640,012 A 2/1987 Thomas
4,756,082 A 7/1988 Apprille, Jr.
4,785,534 A * 11/1988 Lazarchik ..... 30/527
4,797,998 A 1/1989 Motta
4,813,131 A 3/1989 Gruner
4,901,437 A 2/1990 Iten
4,916,814 A 4/1990 Althaus
4,941,492 A 7/1990 Morgan
4,970,784 A * 11/1990 Althaus et al. ..... 30/527
4,980,974 A 1/1991 Radcliffe
5,038,472 A 8/1991 Iderosa
5,046,249 A 9/1991 Kawara et al.
5,056,221 A 10/1991 Thoene ..... 30/41
5,070,614 A 12/1991 Hardin et al.
5,095,619 A 3/1992 Davis et al. ..... 30/41
5,157,834 A 10/1992 Chen et al.
5,333,383 A 8/1994 Ferraro
5,343,622 A 9/1994 Andrews
5,402,574 A 4/1995 Milner
5,410,810 A * 5/1995 Gillibrand ..... 30/50
5,426,851 A 6/1995 Gilder et al.
5,475,923 A 12/1995 Ferraro ..... 30/51
5,522,137 A 6/1996 Andrews
5,533,263 A * 7/1996 Gilder ..... 30/527
5,546,660 A 8/1996 Burout et al.
5,661,907 A 9/1997 Apprille, Jr.
5,781,997 A 7/1998 Ferraro et al.
5,787,586 A 8/1998 Apprille, Jr. et al.
5,799,549 A 9/1998 Decker et al.
5,813,293 A 9/1998 Apprille, Jr. et al.

* cited by examiner

PIVOTABLE AND FLEXIBLE RAZOR ASSEMBLY AND CARTRIDGE

FIELD OF THE INVENTION

The present invention relates to flexible and pivotable razor cartridges and associated assemblies.

BACKGROUND OF THE INVENTION

In recognition of the fact that surfaces to be shaved are not perfectly planar, razor cartridges have been designed to flex during shaving. In order to maximize the flexibility of the cartridges, including associated blades, various designs have been developed. For example, one advantageous design is disclosed in U.S. Pat. No. 5,475,923 where a segmented guard bar is utilized. That design has proven to be very successful in providing overall flexibility to the razor cartridge without noticeable distortion to the blade geometry during shaving.

The consistent achievement of a close, safe and comfortable shave depends upon careful control of the blade geometry. While prior art designs including the design discussed above in connection with the '923 patent have been acceptable, a need continues to exist for a razor cartridge with improved flexibility.

The present invention overcomes the drawbacks of the prior art by providing a razor cartridge which may include one or more blades which utilizes flexible beams to provide enhanced flexibility.

In an effort to increase comfort and shaving efficiency, many shaving razor assembly designs having pivotable razor cartridges have been developed. However, existing pivotable cartridges do not have the ability to flex.

Notwithstanding these prior art designs, a need for pivotable razor assembly designs having improved features such as enhanced flexibility, stability, smoothness in operation and the like continues to exist.

SUMMARY OF THE INVENTION

The present invention overcomes the drawbacks in the prior art by providing a razor cartridge and associated razor assembly which is both pivotable and flexible. The present invention also overcomes drawbacks associated with the prior art by providing a razor cartridge which can flex through a neutral plane of an associated shaving aid so as to prolong the life thereof.

In accordance with one aspect of the present invention, a razor cartridge is provided which comprises a frame having a front section and a rear section, a cap arranged at the rear section and a guard bar arranged at the front section. A shaving aid may be arranged on the cap and may extend longitudinally along a neutral plane. The cartridge comprises at least one blade supported on the frame that is movable along with the frame upon application of a force encountered during shaving between an at rest position where the at least one blade has a substantially planar configuration and a flexed position where the frame flexes through the neutral plane and where the at least one blade is in a substantially concave or convex configuration with respect to the top surface thereof.

Preferably, the shaving aid comprises a polymer strip. The expected useful life of such strip may be prolonged by flexing of the associated cartridge through the neutral plane.

It is also preferable for the frame and the at least one blade to be constructed and arranged so that the blade can slide longitudinally within a limited range upon movement between the at rest and flexed positions.

In another preferred embodiment, the razor cartridge may comprise one or more flexible beams for facilitating the return of the at least one blade and frame from the flexed position to the at rest position. In this embodiment, the flexible beams may be constructed and arranged to stretch into tension or shrink into compression when deformed to a flexed position.

In order to facilitate securing of the at least one blade to the frame, a pin may be utilized to secure a central portion of the blade to the frame. The frame may comprise first and second opposing end walls having slots therein. The at least one blade may extend longitudinally between the first and second end walls and may be arranged within the slots thereof. In a preferred embodiment, ample space exists to accommodate limited longitudinal sliding of the at least one blade within the slots during flexing thereof.

In another aspect of the present invention, a razor assembly is provided which comprises the razor cartridge as described above in combination with a handle assembly.

In accordance with yet another aspect of the present invention, a razor assembly is provided which comprises a handle assembly and a razor cartridge attached to the handle assembly for pivotal movement between a rear position and a forward position upon application of a force exerted on the razor cartridge during shaving. In accordance with this aspect of the present invention, the razor cartridge may be initially biased to any one of various positions such as its rear most position, forward most position or a central position.

The razor cartridge includes a frame, a fixed length elongated cap forming the upper part of the frame, at least one blade supported on the frame, which blade extends longitudinally along the frame, and at least one flexible spring beam forming a lower part of the frame. The cap, the at least one blade, and the at least one spring beam are movable upon application of a downward force on the cartridge during shaving from at rest positions where they are in substantially planar configurations to flexed positions where they are in substantially concave or convex configurations with respect to their top surfaces.

Preferably, the razor assembly further comprises pivot biasing means for biasing the razor cartridge to its rear position. The pivot biasing means may comprise an elongate spring arm extending upwardly from the handle assembly and having a free end arranged in contact with the razor cartridge whereby the razor cartridge is urged rearwardly.

The inclusion of the flexible spring beams as part of the razor cartridge frame facilitates the at least one blade and the frame itself to return from their flexed positions to their rest positions. The at least one flexible spring beam may be secured to the remainder of the frame below the bottom surface of the at least one blade and may extend longitudinally therewith.

The above features and advantages of the present invention will be more fully understood with reference to the following detailed description when taken in conjunction with the accompanying drawings.

DETAILED DESCRIPTION OF THE PREFERRED EMBODIMENTS

Figure 1:
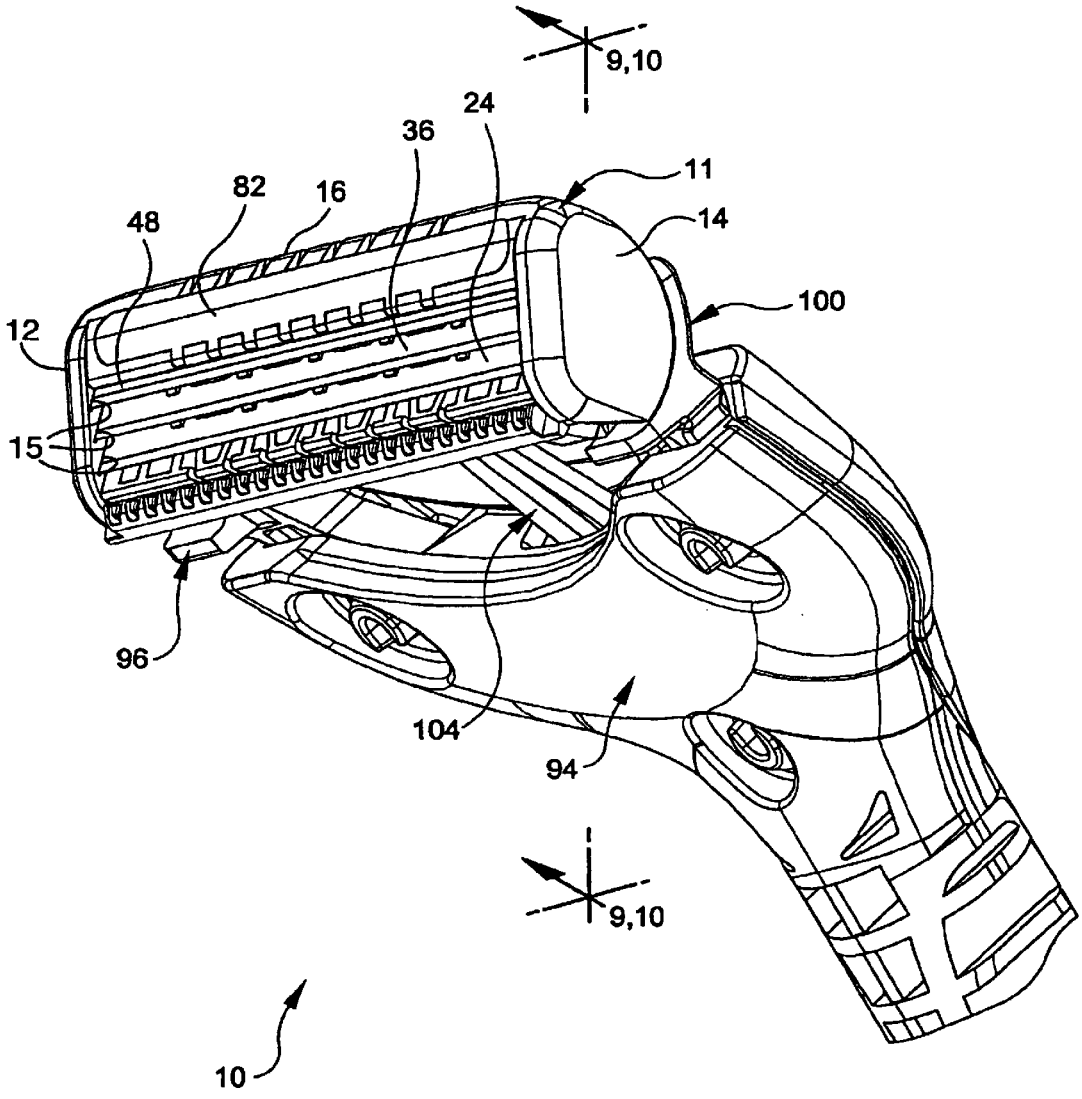
FIG. 1 is a perspective view of a preferred embodiment of the present razor cartridge.

With reference to FIGS. 1–10, the razor assembly 10 includes a razor cartridge 11 and an associated handle assembly 94. The cartridge 11 has a frame 16 with opposing first and second end members 12 and 14 and with a central frame section extending between the end members. In the preferred embodiment, the central frame section is integral with the first and second opposing end members 12 and 14.

Figure 2:
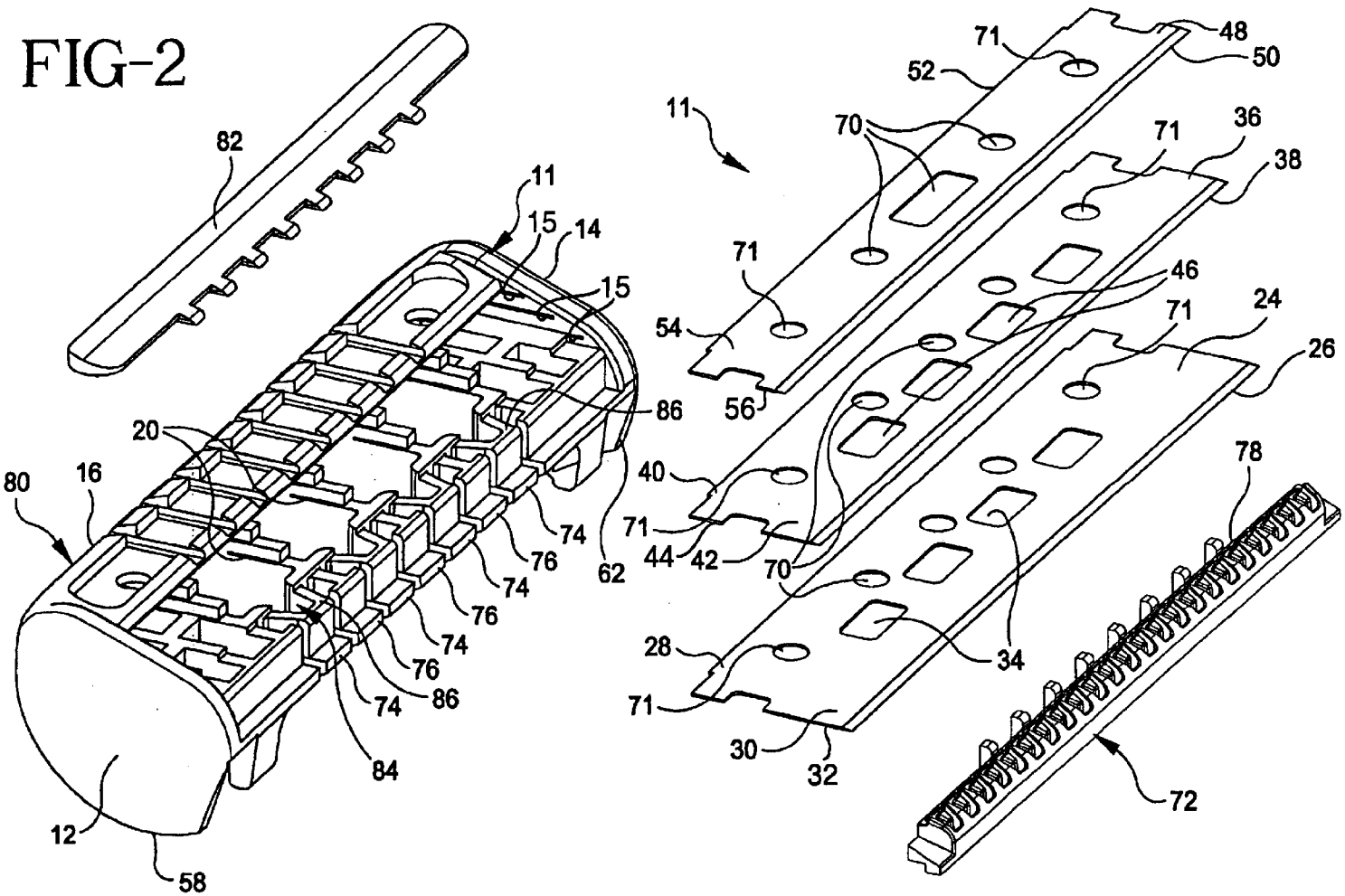
FIG. 2 is an exploded view of the razor cartridge shown in FIG. 1.
Figure 3:
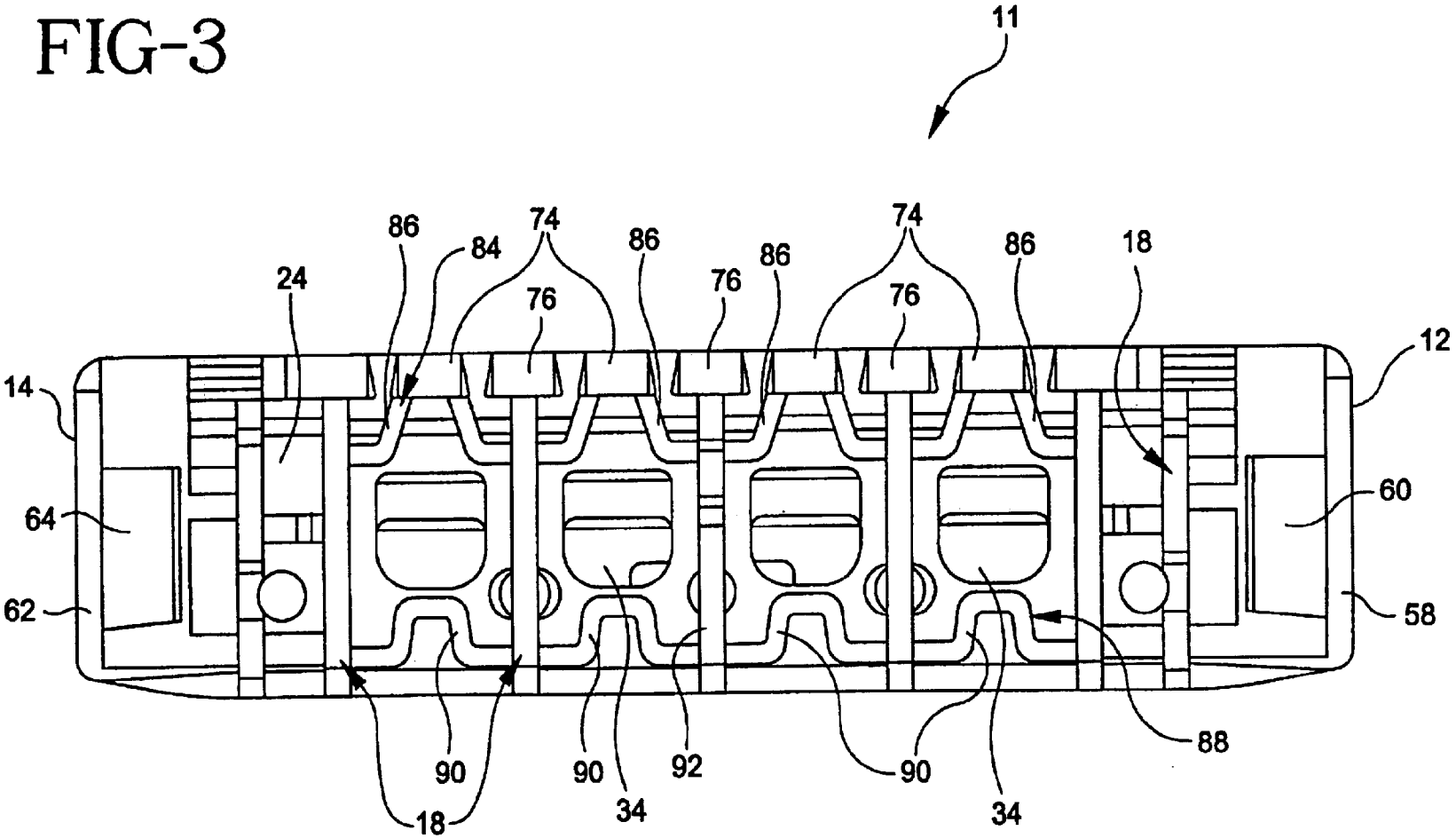
FIG. 3 is a bottom plan view of the razor cartridge shown in FIG. 1.
Figure 4:
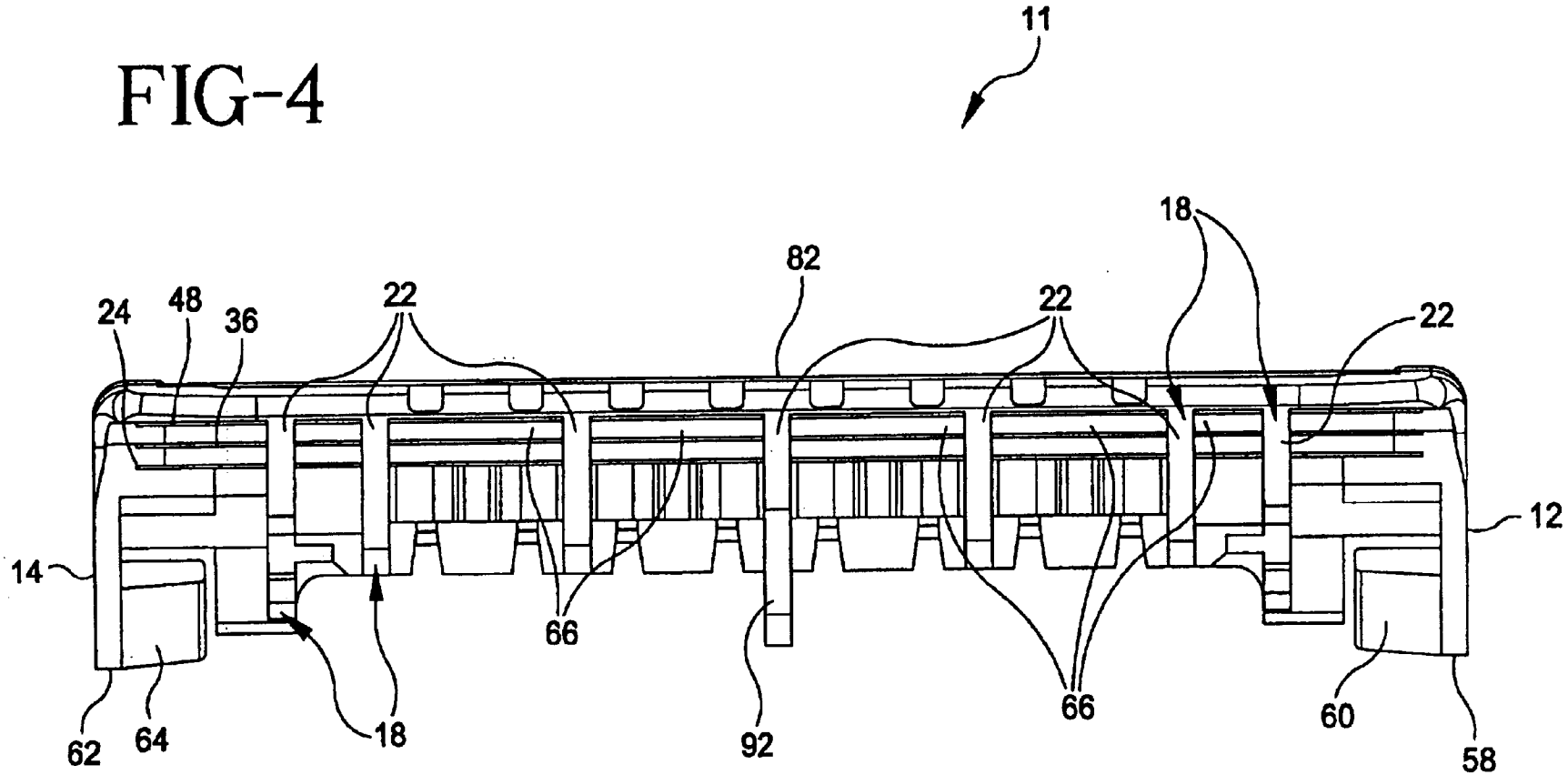
FIG. 4 is a rear view of the razor cartridge shown in FIG. 1.
Figure 5:
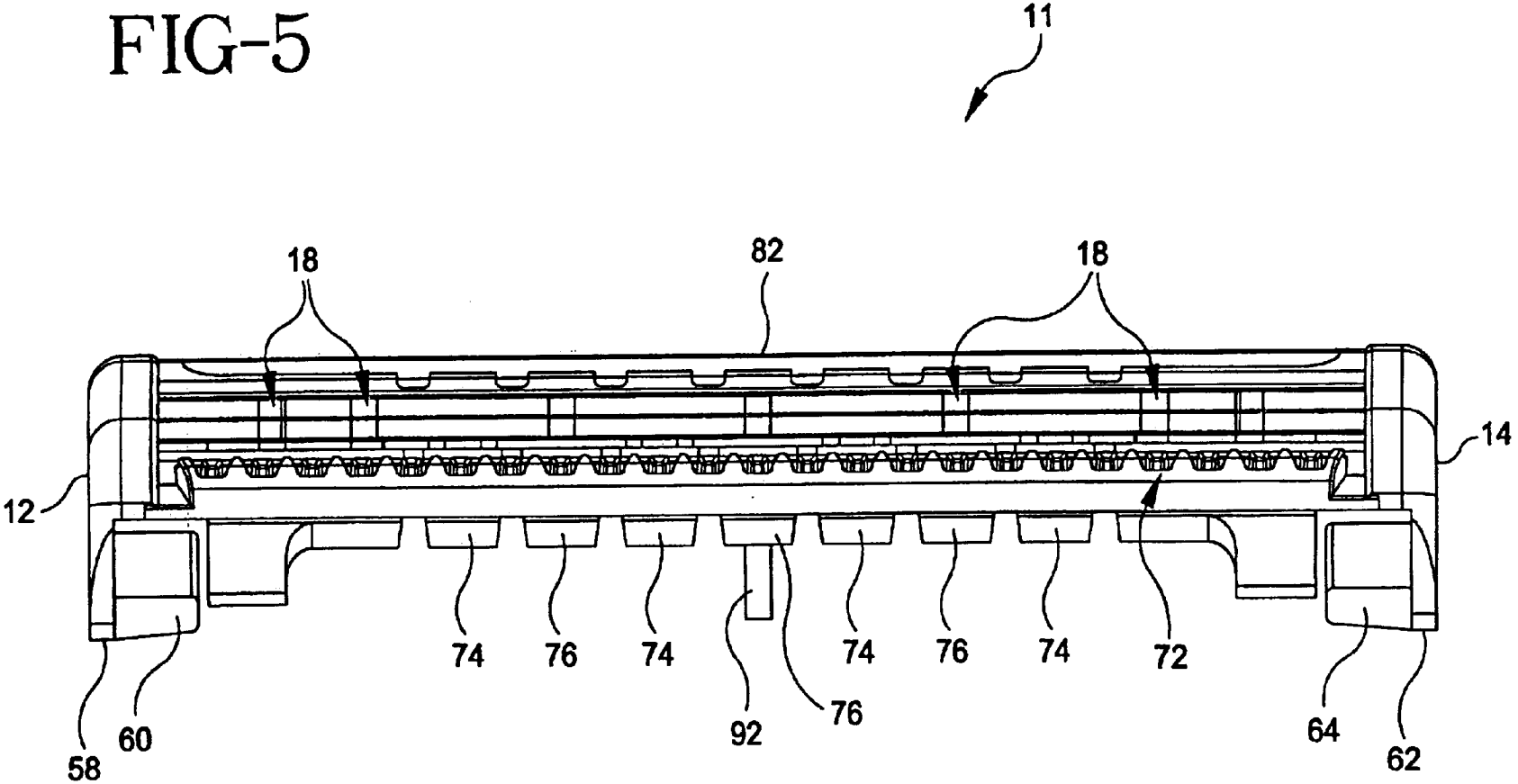
FIG. 5 is a front view of the razor cartridge shown in FIG. 1.
Figure 6:
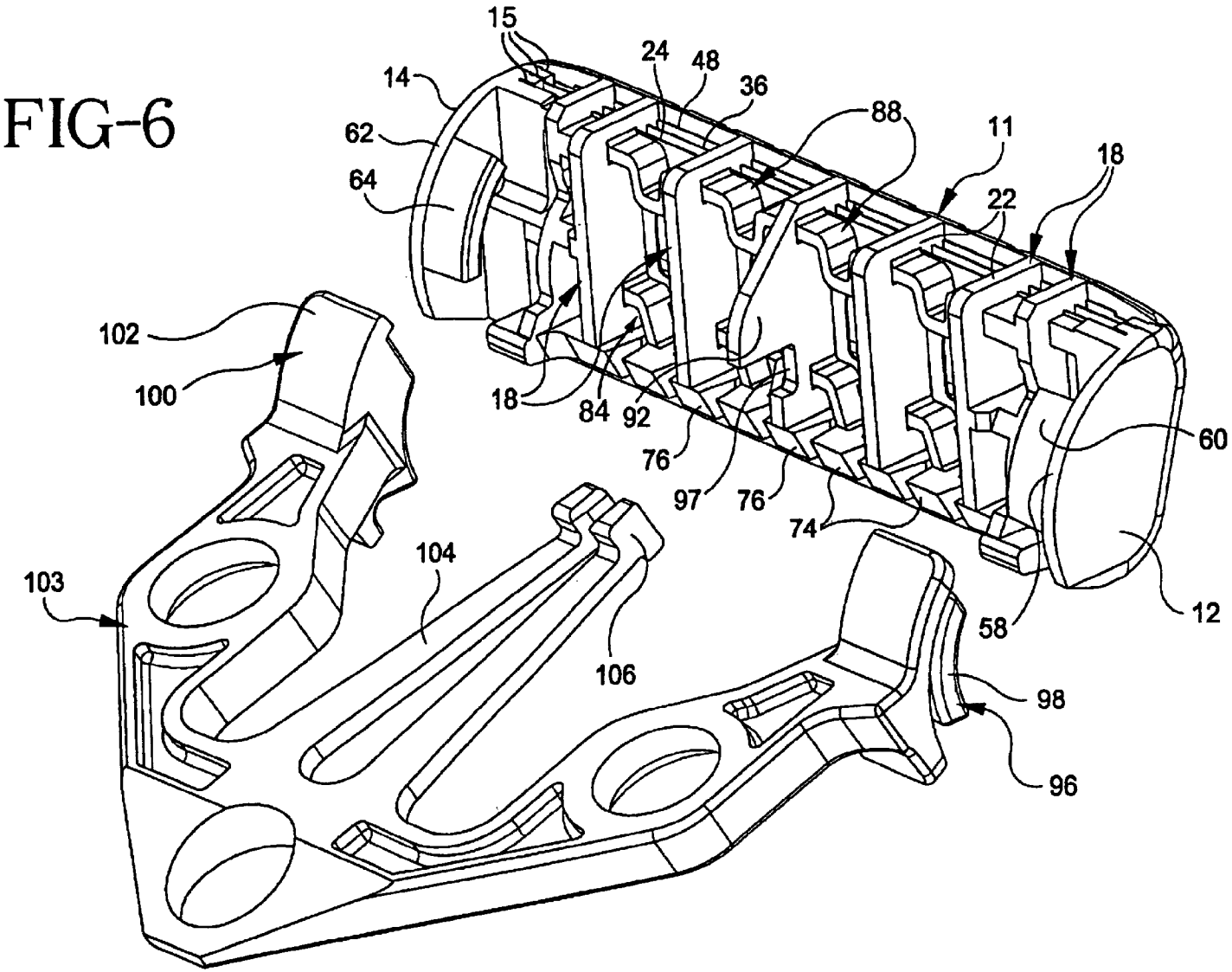
FIG. 6 is a partially exploded perspective view of the present razor cartridge and a portion of an associated handle.
Figure 7:
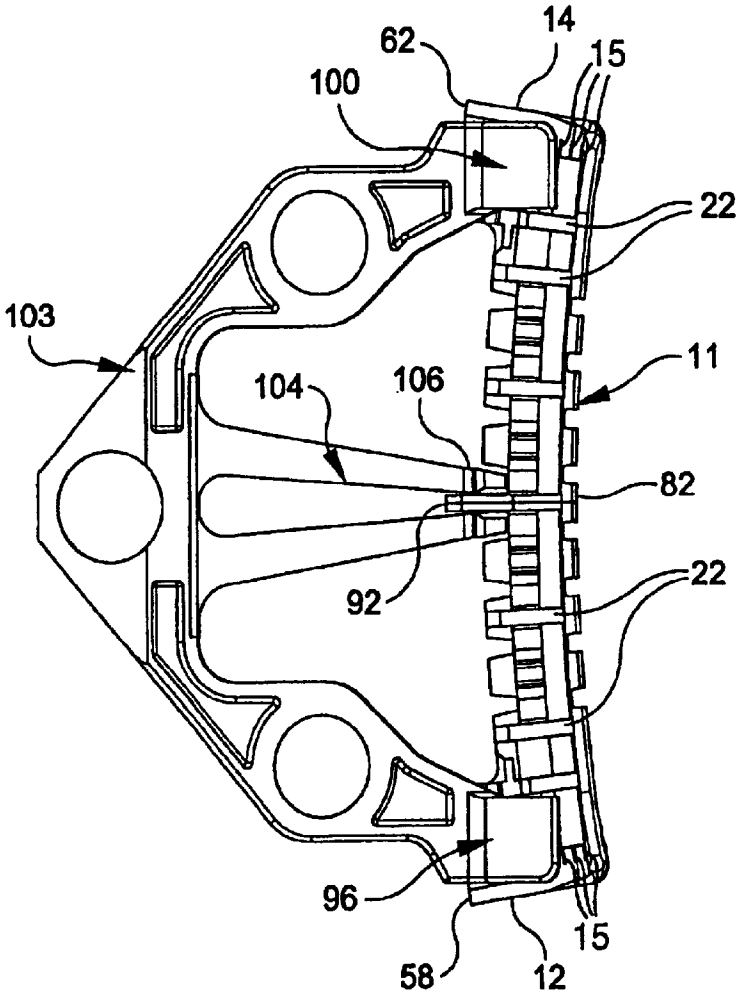
FIG. 7 is a rear view of the razor cartridge illustrated in a mounted position on a portion of an associated handle and shown in a flexed configuration.

The frame 16 includes a plurality of vertically arranged ribs 18 as shown in FIGS. 1, 3 and 4. The ribs may be equidistantly spaced from each other. In alternate embodiments, the razor cartridge 11 may include one or more vertically arranged ribs unevenly spaced from each other. In the preferred embodiment shown in FIGS. 1–10, ribs 18 provide support for three razor blades 24, 36 and 48. Each of the ribs 18 include several longitudinal slots 20 in which the razor blades 24, 36 and 48 are respectively arranged. The ribs have rear faces 22 as shown in FIGS. 4, 6 and 7.

Although the cartridge 11 shown in the preferred embodiment of FIG. 1 is a triple bladed cartridge including a seat blade 24, an intermediate blade 36 and a top blade 48, various aspects of the present invention may be used with a cartridge having more or less than three blades.

The seat blade 24 includes a cutting edge 26, a rear edge 28, a top surface 30 and a bottom surface 32. As best shown in FIGS. 2 and 3, the seat blade 24 also includes a plurality of large wash-through holes 34. In a preferred embodiment, each of the wash-through holes 34 is larger than the wash-through holes of prior art razor blades, and may encompass a total area of about 8.0–13.0 $mm^2$, and is more preferably about 12.3 $mm^2$. Of course, in alternate embodiments, the size of the wash-through holes 34 may vary outside of the preferred range. As shown in FIG. 2, the seat blade 24 is supported on the frame 16 in an aligned row of slots 20 of corresponding ribs 18.

The intermediate blade 36 also includes a cutting edge 38, a rear edge 40, a top surface 42 and a bottom surface 44. A plurality of wash-through holes 46 are arranged between the cutting and rear edges 38 and 40 so as to create a passageway between the top and bottom surfaces 42–44. In a preferred embodiment, the wash-through holes 46 are also substantially larger than the wash-through holes of prior art razor blades and each may encompass a total area of about 5.0–7.0 $mm^2$, and is more preferably about 6.4 $mm^2$. As with the wash-through holes 34 of the seat blade, the size of the wash-through holes 34 may vary outside of the preferred range.

Another inventive feature of cartridge 11 is that the wash-through holes become progressively larger in going from an upper to a next lower blade (e.g., the wash through holes 34 of the seat blade 24 are larger than the wash-through holes 46 of the intermediate blade 36). The particular geometric configuration and dimensions of wash-through holes 34 and 46 may vary substantially in alternate embodiments of the present invention. In certain embodiments, each of the wash-through holes may encompass a total area of at least 4 $mm^2$. However, in other embodiments, each of the wash-through holes in the various blades of cartridge 11 may encompass a total area of less than 4 $m^2$.

The cartridge 11 also includes a top blade 48. Unlike the seat blade 24 and the intermediate blade 36, the top blade 48 need not include any wash-through holes. In a preferred embodiment, the top blade 48 is somewhat conventional in that it includes a cutting edge 50, a rear edge 52, a top surface 54 and a bottom surface 56. However, in alternate embodiments, the top blade 48 may also include wash-through holes.

Figure 9:
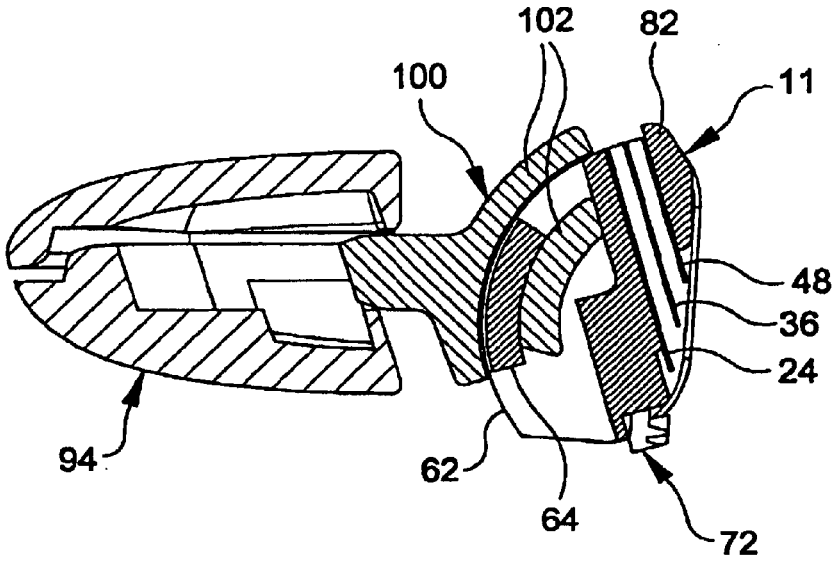
FIG. 9 is a schematic side cross-sectional view of the razor assembly of FIG. 1 shown in an at rest position.
Figure 10:
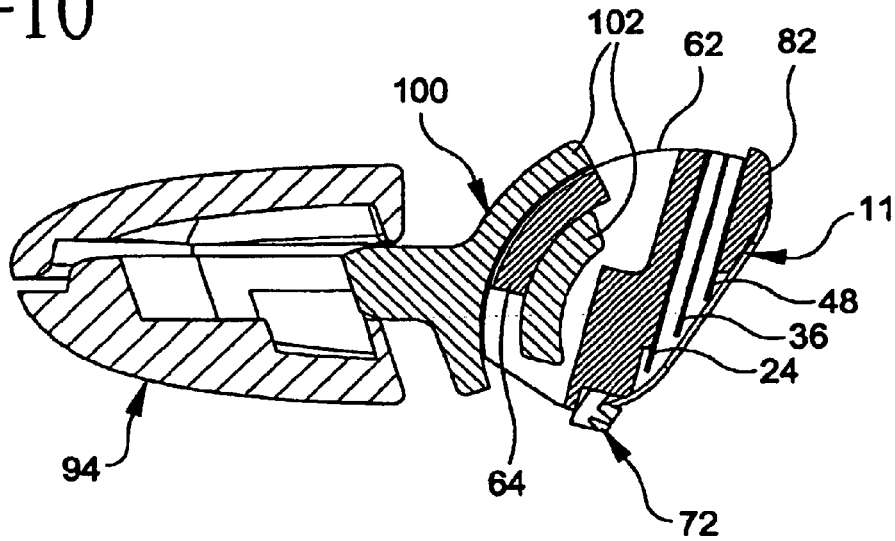
FIG. 10 is a schematic side cross-sectional view of the razor assembly of FIG. 9 shown in a pivoted configuration.

With respect to the triple-bladed construction of the cartridge 11, as shown in FIGS. 1, 9 and 10, the associated razor blades (i.e., seat blade 24, intermediate blade 36 and top blade 48) have a progressively shorter width (from their rear to front edges) in order to maintain desired span and exposure angles for shaving efficiency. However, the present invention is not limited to any particular blade dimension, configuration or geometry.

In the preferred embodiment described herein and shown in the accompanying drawings, the entire razor assembly 10 of the present invention is disposable. However, in alternate embodiments of the present invention, only the cartridge may be disposable.

The purpose of wash-through holes 34 and 46 is to facilitate removal of shaving cream and hair which may become lodged between blade surfaces during shaving. The cartridge 11 is generally designed to maximize rinsability (i.e., wash-through). While one aspect of the improved wash-through is due to the arrangement of the wash-through holes, another aspect relates to the straight wash-through as discussed below.

It is desirable to maximize the overlap of the wash-through holes 34 and 46. In the preferred embodiment where the wash-through holes 34 of the seat blade 24 are larger than the wash-through holes 46 of the intermediate blade 36, it is desirable to maximize the area of each wash-through hole 34 arranged directly above a corresponding area of one of the wash-through holes 46.

In a preferred embodiment, a relatively small distance may exist between the forward-most portion of wash-through holes 46 and the forward-most edge of intermediate blade 36. In other embodiments, the edge of intermediate blade 36 may be positioned so that it is actually arranged over a portion of the wash-through holes 46. While this arrangement is desirable from a wash-through perspective, it is difficult to achieve due to desired span and exposure, dimensions and angles.

It is also desirable for the side edges of each wash-through hole 34 to be arranged over a corresponding wash-through hole 46. However, in alternate embodiments, it is not necessary for the side edges of wash-through holes 34 to overlap corresponding wash-through holes 46.

Yet another significant aspect of the present invention is that the cartridge 11 facilitates a straight wash-through (i.e., from the front through the rear of the blades) of otherwise trapped shaving cream and hair in that it does not include a solid rear wall. Instead, the only rear wall sections of the cartridge 11 are those associated with first and second end members 12 and 14 and the rear faces 22 of the ribs 18. As illustrated in FIG. 4, the cartridge 11 includes relatively large open sections 66 through which deposited shaving cream and hair can be rinsed. This aspect of the present invention will also be discussed further below in connection with the operation thereof. In a preferred embodiment, the open sections 66 encompass a greater width than the solid wall sections, such as the width of rear faces 22 of rib 18. By way of example, each of the open sections 66, may have a width of about 5.2 mm, while the width defined by each of the rear faces 22 of ribs 18 may be about 0.8 mm.

While the combination of the progressively larger wash-through holes and the straight wash-through feature facilitate the substantially improved wash-through characteristics of the cartridge 11, it should be appreciated that each of these features by themselves provide substantial advantages over prior art razor cartridges. Similarly, the relatively large wash-through hole size by itself is also an advantageous feature.

As illustrated in FIGS. 1, 2, 6 and 8, the first end member 12 includes an arcuate bottom surface 58 and a journalled end member 60 which extends inwardly toward the second side member 14. Similarly, the second side member 14 includes an arcuate bottom surface 62 and a journalled end member 64 which extends inwardly toward the first end member 12. The journalled end construction of cartridge 11 is an innovative feature which facilitates improved pivotability between the cartridge 11 and handle assembly 94. As shown in FIG. 5, the journalled end members 60 and 64 are tapered inwardly to allow the cartridge to pivot while it is in a flexed configuration.

In a preferred embodiment, the axis about which the cartridge 11 pivots extends between the cap 80 and guard bar 72, and is located on the shave plane (i.e., a tangent line between the cap and the guard bar). This arrangement optimizes blade contact with a person's skin during shaving.

In a preferred embodiment, the curved journalled end members 60 and 64 are integral with their corresponding side members 12 and 14 and extend inwardly toward the other side member. Further, journalled end members 60 and 64 preferably follow the contour of associated arcuate bottom surfaces 58 and 62, respectively.

In addition to being mounted within the slots 20 of the ribs 18, the razor blades 24, 36 and 48 may be secured in assembled position within the cartridge frame 16 by posts (not shown) which extend through corresponding post holes 70 (FIG. 2) arranged near the rear section of all of the blades. As is known in the shaving razor field, the posts may be formed when the cartridge 11 including the blades are retained in a fixture. Outer holes 71 may have the same configuration as post holes 70, but are used to locate the razor blades 24, 36 and 48 during the manufacturing process.

The cartridge 11 is shown in FIGS. 1, 2 and 5 as including a guard bar 72. As is known to those skilled in the art, a guard bar is designed to be the first element of a safety razor to contact a person's skin during the shaving stroke. The guard bar 72 will control the manner in which the skin approaches the cutting edge 26 of the seat blade 24. The guard bar 72 may be a molded rubber strip having a herring bone design or other desired design to facilitate the flow of skin over the guard bar segments during shaving.

In assembled position, the guard bar 72 is retained on a seat formed of segments 74 and 76, which have a unique structure. In particular, each of the segments 74 is formed on a corresponding portion of a front horizontal flexible spring beam 84 (described further below), while each of the segments 76 is formed on the forward-most portion of a corresponding rib 18.

The cartridge 11 also includes a cap 80, which forms an upper part of the frame 16. The cap 80 is arranged above and in back of the top blade 48. As evident from FIGS. 1, 2 and 7, a shaving aid 82 may be arranged on cap 80. Various materials have been used in the prior art as shaving aids and may also be used in connection with the present invention. The term "shaving aid" as used herein, refers equally either to the active ingredient combined with a delivery system, such as a water-insoluble microporous matrix structure or to the active ingredient alone. Previously suggested active ingredients include those in U.S. Pat. No. 4,170,821 to Booth, which is hereby incorporated by reference. A shaving aid may comprise one of various combinations of the following:

A. A lubricating agent for reducing the frictional forces between the razor and the skin, e.g., a microencapsulated silicone oil.

B. An agent which reduces the drag between the razor parts and the shaver's face, e.g., a polyethylene oxide in the range of molecular weights between 100,000 and 6 million; a non-ionic polyacrylamide; and/or a natural polysaccharide derived from plant materials such as "guar gum."

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium lauryl sulphate.

E. A medicinal agent for killing bacterial, or repairing skin damage and abrasions.

F. Cosmetic agent for softening, smoothing, conditioning or improving the skin.

G. A blood coagulant for the suppression of bleeding that occurs from nicks and cuts.

H. An astringent for constricting blood vessels thereby stemming the flow of bodily fluids such as lymph which may exude from skin which has been irritated during shaving.

Alternatively, the shaving aid may comprise one or more of these shaving aids disclosed in U.S. Pat. Nos. 5,056,221; 4,044,120; and 5,095,619, which are also incorporated herein by references.

Other activate ingredients may include various pigments, e.g., titanium dioxide, fragrances, aloe vera, flavoring agents, mineral oils, essential oils and other oils derived from plants. In addition to one or more active ingredients, the shaving aids of the present invention may also comprise other compounds or blends of compounds such as water insoluble polymers such as polystyrene and polypropylene.

Figure 8:
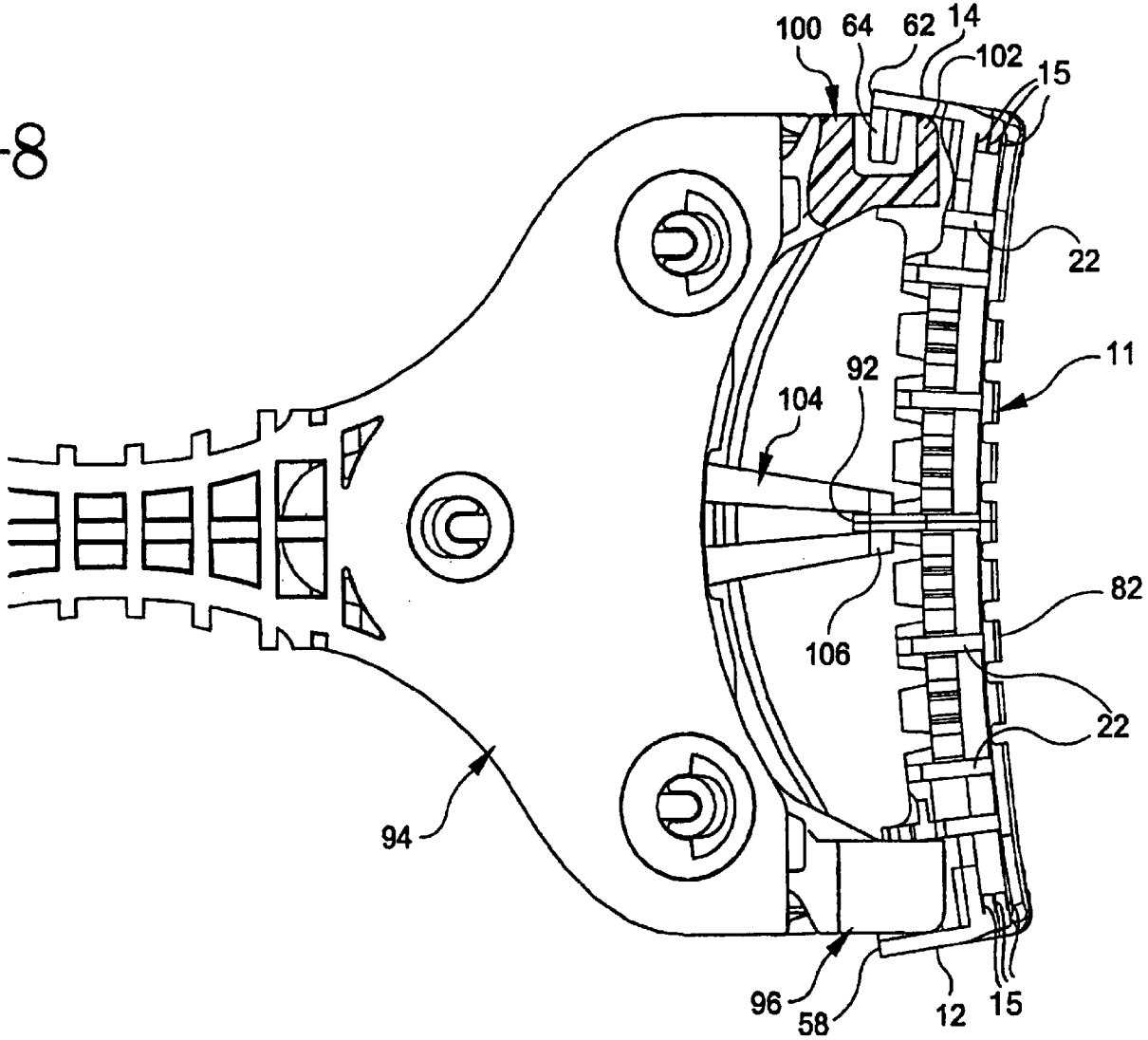
FIG. 8 is a partial cross-sectional view of the razor cartridge shown in FIG. 7.

Although the particular type of shaving aid utilized is not a significant aspect of the present invention, it is inventive that in a preferred embodiment, the razor cartridge 11 is constructed and arranged to flex through an imaginary plane which extends through the shaving aid 82. Such flexing of the razor cartridge 11 is shown in FIGS. 7 and 8. When the razor cartridge 11 flexes, each of the razor blades 24, 36 an 48 bends from its rest position, where it has a substantially planar configuration to a configuration where the top surface thereof obtains a concave configuration. However, it should also be appreciated that the razor cartridge 11 may also flex so that the blades obtain a convex configurations with respect to the top surfaces thereof. Such flexing may be desirable in, for example, a women's razor.

Another significant aspect of the cartridge 11 is that it includes horizontally extending spring beams, such as the front beam 84 and a rear beam 88 which can resiliently stretch or compress to facilitate the flexible nature of the cartridge 11. In particular, the front horizontal beam 84 comprises a plurality of segments 86 which collectively form a saw-tooth spring pattern. The rear horizontally extending spring beam 88 comprises separate segments 90 which have an appearance substantially similar to the collective appearance of the segments of the front horizontal beam 84. The segments 86 and 90 are arranged between respective ribs 18 of the cartridge frame 16. The segments 86 of front beam 84 are formed in conjunction with the guard bar support segments 74, as best illustrated in FIG. 3.

The structures of the front spring beam 84 and rear spring beam 88 are also inventive in various ways including their generally horizontally extending structure. In addition, the connection between the segments 86 of the front horizontally extending beam 84 and guard bar segments 74 is inventive.

The front beam 84 and rear beam 88 are generally constructed and arranged to flex as parts of the cartridge frame 16 when an appropriate force is encountered during shaving. Upon flexing to concave conditions, horizontal beams 84 and 88 are placed under tension and thus bias the cartridge frame 16 to return to its at-rest position where the blades 24, 36 and 48 are in a substantially planar configuration. Thus, one function of horizontal beams 84 and 88 is to bias the razor cartridge 11 to return to its at-rest position from a flexed position.

The combination of front beam 84 and rear beam 88 is also beneficial in that it provides structural integrity to the cartridge 11. In particular, such combination helps prevent the cartridge 11 from twisting when shaving forces are applied.

Yet another significant aspect of the present invention is that the razor assembly 10 includes a cartridge 11 which is both flexible and pivotable. The center rib 18 includes a downwardly extending bearing surface 92 which, is used, in a preferred embodiment to facilitate pivoting of the cartridge 11 as discussed below.

As shown in FIG. 6, the center rib 18 also includes a notch 97 to provide clearance from a contact surface 106 of a spring arm 104 to allow the cartridge 11 to flex where the top surface of the blades obtain a concave configuration. The notch 97 includes an upper surface that acts as a stop with respect to the contact surface 106 so that the cartridge 11 will not overflex.

The razor assembly 10 also includes a handle assembly 94 on which the cartridge 11 is pivotably mounted. In particular, the handle assembly 94 includes first and second side curved journal members 96 and 100, respectively. This aspect of the present invention is shown in FIGS. 1 and 6–10. The first side curved journal member 96 includes capture member 98 while the second side curved journal member 100 includes capture member 102. As evident from FIG. 8, the cartridge 11 is mounted on the handle assembly 94 by securing the arcuate journalled end members 60 and 64 on corresponding first and second curved journal members 96 and 100. More particularly, the curved journalled end members 60 and 64 of cartridge 11 are arranged within the curved passageway formed between a corresponding one of the curved journal members 96 and 100 and their respective capture members 98 and 102. This mounting structure may be considered a "clam shell" pivot arrangement formed by the cooperating curved journal members 96 and 100 with the curved journalled end members 60 and 64 of the cartridge 11.

As schematically illustrated in FIG. 9, the cartridge 11 of razor assembly 10 is initially biased to its rear-most position. As used herein, this rearward biased cartridge arrangement is also referred to as a "unidirectional" pivot arrangement. Such arrangement has certain advantages such as the elimination of deadband (i.e., where the cartridge is not under a spring-loaded or other bias force). The existence of deadband is undesirable because it may result in vibration of the cartridge 11 during handling of the razor assembly 10. However, it should be appreciated that the particular pivot arrangement may be modified in alternate embodiments of the present invention. For example, a forward biased (also unidirectional) or center biased pivot arrangement (bidirectional) may be used in place of the rearward biased pivot arrangement.

In the rearward biased embodiment schematically shown in FIG. 10, an upwardly extending spring arm 104 (best shown in FIGS. 6 and 7) extends from an end of the handle assembly 94. The spring arm 104 includes contact surface 106 at a top portion thereof which engages the downwardly extending bearing surface 92 from the center rib 18 of the cartridge 11. This structure urges the cartridge 11 to pivot to its rear-most position when the razor assembly 10 is not in use.

The contact surface 106 of spring arm 104 includes two bosses that provide a groove through a central portion of contact surface 106. The groove (unnumbered) receives the center rib 18 of the cartridge 11. When the cartridge 11 flexes during shaving, the journalled end members 60 and 64 open up as illustrated in FIG. 7. The groove between the bosses maintains the cartridge 11 in a centered position.

The spring arm 104 has a substantially elongated triangular shape which provides for a desired degree of stiffness to help prevent side-to-side travel of cartridge 11. As best shown in FIGS. 6 and 7, a central portion of the triangular shaped spring arm 104 is cut away to provide the desired spring effect and to allow the center rib 18 of the cartridge 11 to rotate during flexing and/or pivoting of the cartridge 11.

As also illustrated in FIGS. 6 and 7, in a preferred embodiment, an integral "pivot frame" 103 is provided. The pivot frame 103 includes the spring arm 104 and the first and second curved journal members 96 and 100. The integral nature of the pivot frame 103 provides for manufacturing and structural advantages.

In operation, various advantages of the structural features of razor assembly 10 become evident. When the razor assembly 10 is in its at rest position, the cartridge 11 is neither flexed nor pivoted forwardly. However, during shaving, the cartridge 11 is designed to both pivot on the handle assembly 94 and to flex, if necessary. FIGS. 1 and 9 illustrate the razor assembly 10 when arranged in its at rest position prior to shaving. However, when a force is exerted on the razor cartridge 11 during shaving, the cartridge 11 may pivot forwardly (as shown in FIG. 10) on the clam-shell connector structure formed by the first and second bearing surfaces 96 and 100, and curved capture members 98 and 102 of the handle assembly 94 in combination with the curved journalled end members 60 and 64 of the cartridge 11.

As discussed above, the cartridge 11 is constructed and arranged to flex through an imaginary plane which extends through the shaving aid 82. Such arrangement is designed to extend the life of the shaving aid 82 by minimizing cracking and wear thereof.

As is common with any multiple bladed razor, shaving cream and hair will become deposited between the surfaces of blades 24, 36 and 48 of cartridge 11 during use. It is desirable to remove such deposited shaving cream and hair as quickly and easily as possible. Efficient removal of deposited shaving cream and hair is accomplished through the use of several inventive features including the relatively large wash-through holes 34 and 46 of seat blade 24 and intermediate blade 36, respectively; the progressively larger nature of the wash-through holes 34 on seat blade 24 as compared to the wash-through holes 46 of intermediate blade 36; and the straight wash-through arrangement obtained by the open sections 66 at the open rear of cartridge 11. In this regard, when the cartridge 11 is rinsed after a shaving stroke, the water will force deposited shaving cream and hair straight through the cartridge 11 along the top and bottom surfaces of the associated blades and out of the rear sections 66. Removal of the unwanted shaving cream and hair will also be facilitated by wash-through holes 34 and 46.

It should be appreciated that although preferred embodiments of the present invention are discussed above, those of skill in the art are encouraged to modify the disclosed structure and arrangement of various features of the present razor cartridge and assembly without departing from the scope of the present invention, which is defined by the claims set forth below.

What is claimed is:

1. A razor cartridge comprising:

a frame having an upper portion forming an elongated fixed length cap, said frame including first and second opposing end walls;

at least one blade supported on said frame below said cap so that opposite end portions of said blade are slidable relative to the frame; and a flexible front beam and a flexible rear beam forming part of said frame, each of said beams being fixed to and extending between said opposing end walls, and said beams each having a substantially sawtooth pattern extending in a plane substantially parallel to that defined by a bottom surface of the at least one blade;

said cap, said at least one blade and said beams all being movable upon application of a force encountered during shaving between at-rest positions where said cap, said at least one blade and said beams are in substantially planar configurations, and flexed positions where said cap, said at least one blade and said beams are in substantially concave or convex configurations.

2. The razor cartridge of claim 1 wherein a shaving aid is arranged on said cap.

3. The razor cartridge of claim 1 wherein said frame and said at least one blade are constructed and arranged so that said opposite end portions of said blade are free to slide longitudinally relative to said frame within a limited range upon movement of said blade between said at-rest and flexed positions.

4. The razor cartridge of claim 1, wherein said beams are biased when flexed to facilitate the return of said beams and said at least one blade and said cap from said flexed positions to said at-rest positions.

5. The razor cartridge of claim 1, wherein said beams are located below said at least one blade, said beams being unbiased when in said at-rest position and being flexed when moved to said concave configuration and flexed when moved to said convex configuration so as to be biased to facilitate the return of said beams and said at least one blade and said cap to their at-rest positions.

6. The razor cartridge of claim 1, wherein one of said beams carries a plurality of segments which form at least part of a support for a guard bar.

7. The razor cartridge of claim 1 wherein said at least one blade is secured at a central portion thereof to said frame.

8. The razor cartridge of claim 1, wherein said frame further includes a plurality of ribs spaced from one another along the length of said cap, which ribs extend vertically between and are fixed to said cap and to said front and rear beams and, said ribs having horizontal slots therein slidably receiving said at least one blade.

9. The razor cartridge of claim 8, wherein said cap, said opposing end walls, said front and rear beams and said ribs are all of one piece with each other.

10. The razor cartridge of claim 1, wherein the first and second opposing end walls define slots therein, and wherein said at least one blade extends longitudinally between said first and second end walls and has said opposite end portions slidably arranged within said slots of respective ones of said end walls, whereby space exists to accommodate limited longitudinal sliding of said end portions of said at least one blade within said slots during flexing thereof.

11. A razor assembly comprising:

a handle assembly; and a razor cartridge attached to said handle assembly, said razor cartridge including:

a frame having an upper portion forming an elongated fixed length cap said frame including first and second opposing end walls;

at least one blade supported on said frame below said cap so that opposite end portions of said blade are slidable relative to the frame; and a flexible front beam and a flexible rear beam forming part of said frame, each of said beams being fixed to and extending between said opposing end walls, and said beams each having a substantially sawtooth pattern extending in a plane substantially parallel to that defined by a bottom surface of the at least one blade;

said cap, said at least one blade and said beams all being movable upon application of a force encountered during shaving between at-rest positions where said cap, said at least one blade and said beams are in substantially planar configurations, and flexed positions where said cap, said at least one blade and said beams are in substantially concave or convex configurations.

12. The razor assembly of claim 11 wherein a shaving aid is arranged on said cap.

13. The razor assembly of claim 11 wherein said frame and said at least one blade are constructed and arranged so that said opposite end portions of said blade can slide longitudinally relative to said frame within a limited range upon movement of said blade between said at-rest and flexed positions.

14. The razor assembly of claim 11, wherein said beams are biased when flexed to facilitate the return of said beams and said at least one blade and said cap from said flexed positions to said at-rest positions.

15. The razor assembly of claim 11, wherein said beams are located below said at least one blade, said beams being unbiased when in said at-rest position and being flexed when moved to said concave configuration and flexed when moved to said convex configuration so as to be biased to facilitate the return of said beams and said at least one blade and said cap to said at-rest positions.

16. The razor assembly of claim 11 wherein one of said beams carries a plurality of segments which form at least part of a support for a guard bar.

17. The razor assembly of claim 11 wherein said at least one blade is secured at a central portion thereof to said frame.

18. The razor assembly of claim 11, wherein the first and second opposing end walls define slots therein, and wherein said at least one blade extends longitudinally between said first and second end walls and has said opposite end portions slidably arranged within said slots of respective ones of said end walls, whereby space exists to accommodate limited longitudinal sliding of said end portions of said at least one blade within said slots during flexing thereof.

19. A razor assembly comprising:

a handle assembly; and a razor cartridge attached to said handle assembly for pivotal movement between a rear position and a forward position upon application of a force exerted on said razor cartridge during shaving, said razor cartridge including:

a frame having an upper portion forming an elongated fixed length cap, said frame including first and second opposing end walls;

at least one blade having top and bottom surfaces supported on said frame and extending longitudinally therealong so that opposite end portions of said blade are slidable relative to said frame; and a flexible front beam and a flexible rear beam forming part of said frame, said beams each being fixed to and extending between said opposing end walls, and said beams each having a substantially sawtooth pattern extending in a plane substantially parallel to that defined by the bottom surface of the at least one blade;

said cap, said beams, and said at least one blade being further movable upon application of a downward force encountered during shaving from at-rest positions where said cap, said at least one blade and said beams are in substantially planar configurations, and flexed positions where said cap, said at least one blade and said beams are in substantially concave or convex configurations.

20. The razor assembly of claim 19 further comprising pivot biasing means for biasing said razor cartridge to said rear position.

21. The razor assembly of claim 20 wherein said pivot biasing means comprises an elongate spring arm extending upwardly from said handle assembly and having a free end arranged in contact with said razor cartridge whereby said razor cartridge is urged to its rear position.

22. The razor assembly of claim 21, wherein said beams are biased when moved to a concave or convex configuration to facilitate said beams, said at least one blade and said cap to return from said flexed positions to said at-rest positions.

23. The razor assembly of claim 18 wherein said beams are located below said at least one blade and extend longitudinally along said at least one blade.

24. The razor assembly of claim 19, wherein the first and second opposing end walls define slots therein, and wherein said at least one blade extends longitudinally between said first and second end walls and has said opposite end portions slidably arranged within said slots of respective ones of said end walls, whereby space exists to accommodate limited longitudinal sliding of said end portions of said at least one blade within said slots during flexing thereof.

25. A razor cartridge comprising:

a frame having an upper portion forming an elongated fixed length cap;

at least one flexible beam forming part of said frame and located below and parallel to said cap, said at least one flexible beam carrying a plurality of segments which form at least part of a support for a guard bar; and at least one blade supported on said frame below said cap so that opposite end portions of said blade are slidable relative to said frame, said cap, said at least one blade and said at least one beam all being movable upon application of a force encountered during shaving between at-rest positions, where said cap, said at least one blade, and said at least one beam are in substantially planar configurations, and flexed positions, where said cap, said at least one blade, and said at least one beam are in substantially concave or convex configurations, and wherein said frame comprises first and second opposing end walls having slots therein, said at least one blade extending longitudinally between said first and second end walls and having said opposite end portions slidably arranged within said slots of respective ones of said end walls whereby space exists to accommodate limited longitudinal sliding of said end portions of said at least one blade within said slots during flexing thereof.

26. A razor assembly comprising:

a handle assembly; and a razor cartridge attached to said handle assembly, said razor cartridge including a frame having an upper portion forming an elongated fixed length cap, at least one flexible beam forming part of said frame and located below said cap, said at least one flexible beam carrying a plurality of segments which form at least part of a support for a guard bar, and at least one blade supported on said frame below said cap so that opposite end portions of said blade are slidable relative to said frame, said cap, said at least one blade, and said at least one beam all being movable upon application of a force encountered during shaving between at-rest positions where they are in substantially planar configurations and flexed positions where they are in substantially concave or convex configurations, and wherein said frame comprises first and second opposing end walls having slots therein, said at least one blade extending longitudinally between said first and second end walls and having said opposite end portions slidably arranged within said slots of respective ones of said end walls whereby space exists to accommodate limited longitudinal sliding of said end portions of said at least one blade within said slots during flexing thereof.

* * * * *